US007537463B1

(12) United States Patent
Farole et al.

(10) Patent No.: US 7,537,463 B1
(45) Date of Patent: May 26, 2009

(54) MECHANICALLY INTERCONNECTED FOIL CONTACT ARRAY AND METHOD OF MANUFACTURING

(75) Inventors: Dominic Anthony Farole, Hummelstown, PA (US); Keith Edwin Miller, Manheim, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/934,165

(22) Filed: Nov. 2, 2007

Related U.S. Application Data

(60) Provisional application No. 60/864,850, filed on Nov. 8, 2006.

(51) Int. Cl.
*H01R 12/00* (2006.01)

(52) U.S. Cl. ..... 439/74; 439/495

(58) Field of Classification Search ..... 439/74, 439/66, 495

See application file for complete search history.

(56) References Cited

U.S. PATENT DOCUMENTS 5,099,392 A * 3/1992 Miller et al. ..... 361/760
5,145,381 A * 9/1992 Volz ..... 439/62
5,639,260 A * 6/1997 McHugh ..... 439/495
5,928,003 A * 7/1999 Kajinuma ..... 439/74
6,302,704 B1 * 10/2001 Belanger, Jr. ..... 439/67
7,059,893 B2 * 6/2006 Ono et al. ..... 439/495
7,410,364 B2 * 8/2008 Kishi et al. ..... 439/74
2005/0268911 A1 12/2005 Cross et al.

* cited by examiner

*Primary Examiner*—Truc T Nguyen

(57) ABSTRACT

An array of ultra-thin metallic foil strips of predetermined thickness electrically connected to a printed circuit board, cables or attached to wires. An associated power source, on the printed circuit board, or attached to the circuit board, cables or wires, directs an electrical current through one or more of the strips in the array of foil strips. Depending upon the use of the circuit board, the foil strips can be used to start or to end an operation. The selection of the foil strip makes use of the electrical properties of the selected metal such as its resistivity as well as the thickness, length and width of the foil strips to provide a strip with characteristics required to achieve a preselected result. As an electric current is provided by a power source, it passes through contacts connected to the one or more foil strips. The application of current through the metallic material can be used to achieve a number of results, such as to act as a heating element.

8 Claims, 5 Drawing Sheets

MECHANICALLY INTERCONNECTED FOIL CONTACT ARRAY AND METHOD OF MANUFACTURING

This application claims the benefit of the filing date of Provisional Application 60/864,850 entitled MECHANICALLY INTERCONNECTED FOIL CONTACT ARRAY AND METHOD OF MANUFACTURING filed on Nov. 8, 2006.

FIELD OF THE INVENTION

The present invention is directed to an ultra-thin flexible circuit and specifically to the use of the ultra-thin flexible circuit to control an operation.

BACKGROUND OF THE INVENTION

Microchip devices have been used for a wide variety of applications. However, these devices have not included ultra-thin metal foils. Simple problems faced in utilizing these ultra-thin foils in microchip devices include handling the foils, as they are susceptible to tearing. More complex problems include assembling the foils to other components of the microchip devices. These methods are required to establish good mechanical contact between the foil and the associated devices, as well as applying normal forces to the foil without damaging it so as to retain it in position once mechanical contact is established. Since the ultra-thin metal foils in microchip devices will carry electrical current, it is also difficult and necessary to clean the surface of the foils of oxides without damaging, tearing or puncturing the foil.

Before ultra-thin metal foils can be used as production items for microchips, solutions to these problems must be found. Uses for such ultra-thin foils in microchips are limited because of these problems, but will expand once solutions to these problems are presented.

SUMMARY OF THE INVENTION

The present invention is an array of metallic foil strips of predetermined thickness electrically connected to a printed circuit board, cables or attached to wires. An associated power source, on the printed circuit board, or attached to the circuit board, cables or wires, directs an electrical current through one or more preselected strips in the array of foil strips. Depending upon the use of the circuit board, the foil strips can be used to start or to end an operation.

The selection of the foil strip makes use of the electrical properties of the metal such as its resistivity as well as the thickness and width of the foil strips to provide a strip with characteristics required to achieve a preselected result. As an electric current is provided by a power source, it passes through contacts connected to the one or more foil strips. The application of current through the metallic material can be used to achieve a number of results. For example, the current can cause the temperature of one or more foil strips to increase, due to the resistivity of the selected metal, causing the foil to act as a heating element.

There are a number of factors that can be varied to achieve a preselected foil temperature. Certainly, one of the factors is the resistivity of the metallic material selected. The thickness of the foil as well as the width of the metallic material in a strip can also affect the foil temperature. Of course, the current supplied also affects the foil temperature. Thus, by careful selection of the metallic material, foil thickness, foil width and foil length and current supplied, the effective temperature of the foil, and a control device, which may conveniently be included on a printed circuit board, the metal foil an be used as a variable heating element to carefully control the temperature within a confined space.

Yet another advantage of the present invention is that the printed circuit board can be used multiple times before replacement by providing the printed circuit board with logic to apply the current to different elements in the array of foil strip elements sequentially or in seriatim.

Another advantage of the present invention is that the foil can be used as a coated substrate, the substrate being protected from exposure to an environment until a predetermined temperature is achieved, thereby liberating a coating material on the substrate and exposing the substrate.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
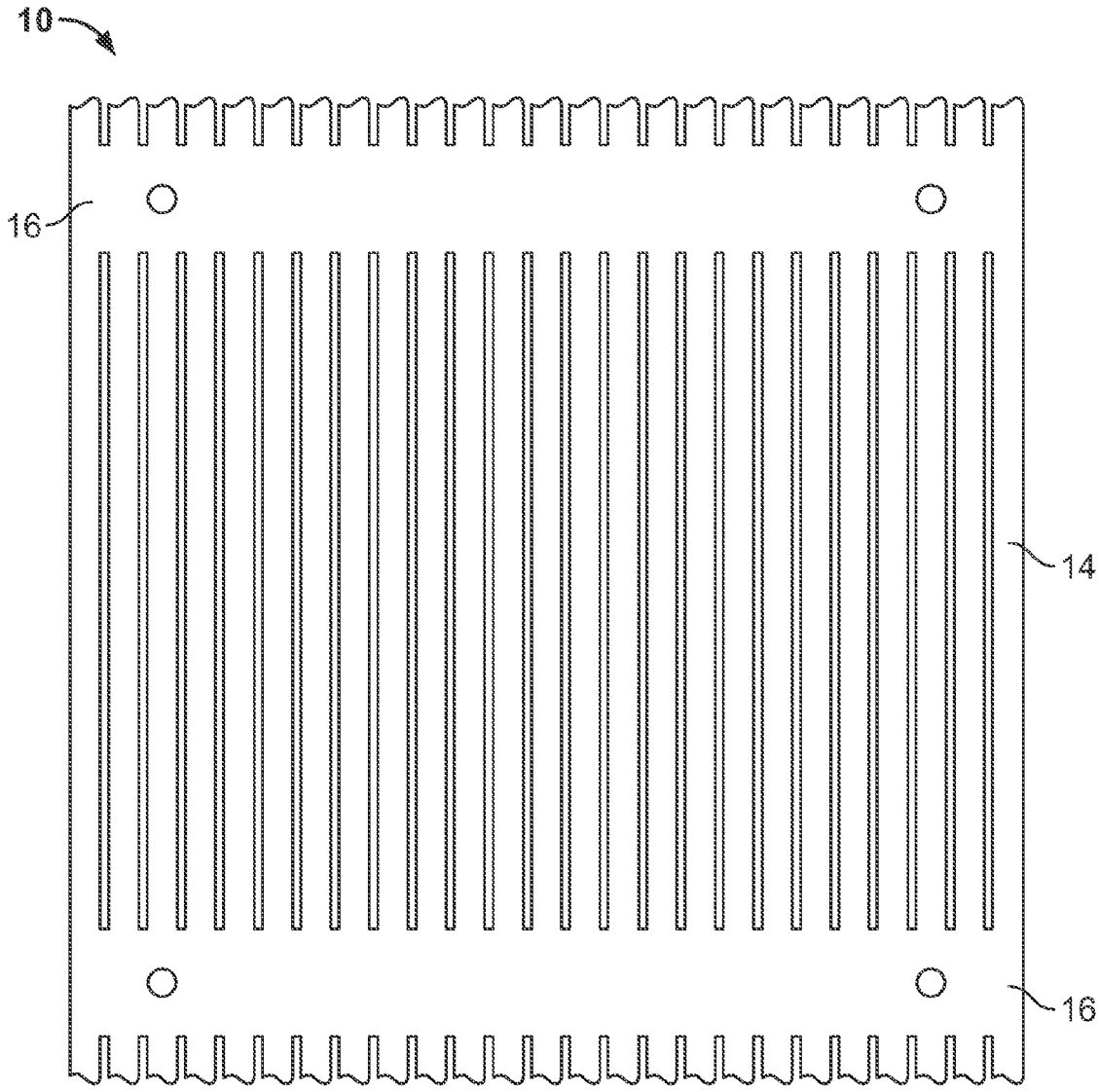
FIG. 1 is a perspective view of a foil array of the present invention.
Figure 2:
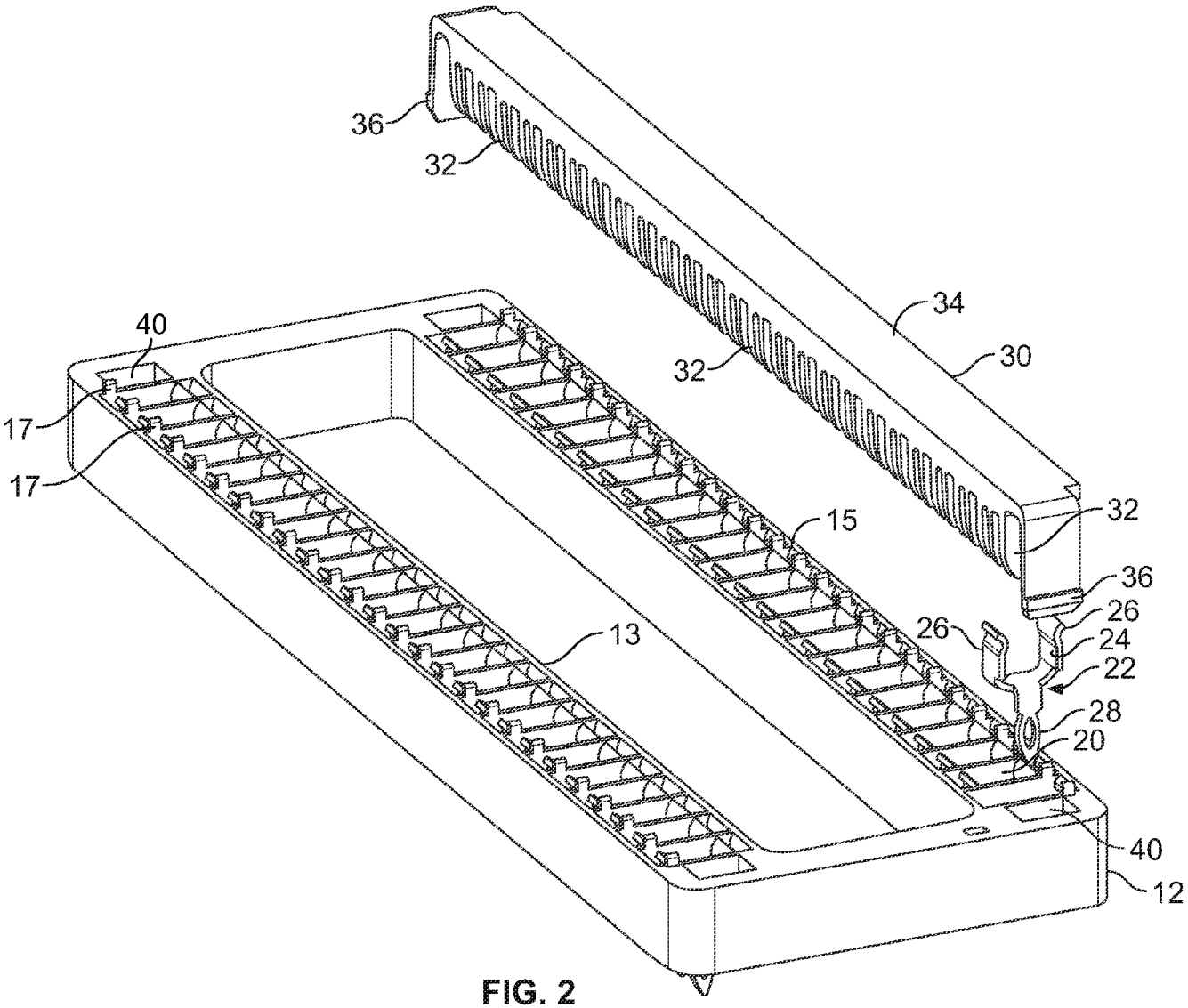
FIG. 2 is an exploded view of the housing having apertures, a contact adjacent to one of the apertures and a beam of the present invention.

The present invention provides an ultra-thin metallic foil as an array of strips electrically connected to a power supply that provides an electrical current through the metallic foil. As used herein, an ultra-thin metallic foil means a metallic foil having a thickness of 0.005 inches and thinner. Preferably, the ultra-thin metallic foil is connected to a printed circuit board (PCB) that either includes the power supply or is connected to the power supply. Preferably the foil connections are mechanical in nature, although the foil also can function when connected metallurgically, such as by soldering. A foil array 10 is depicted in FIG. 1. An exploded view of a housing 12, a contact 22 and a beam 30 are shown in FIG. 2. Housing includes a plurality of apertures 20. A contact 22 is assembled into the apertures 20. Depending on the strip, it is not necessary that a contact 22 be assembled into every aperture. However, in order to complete a circuit, it is necessary for a contact to be assembled onto corresponding apertures on opposed sides 13, 15 of housing 12.

Figure 3A:
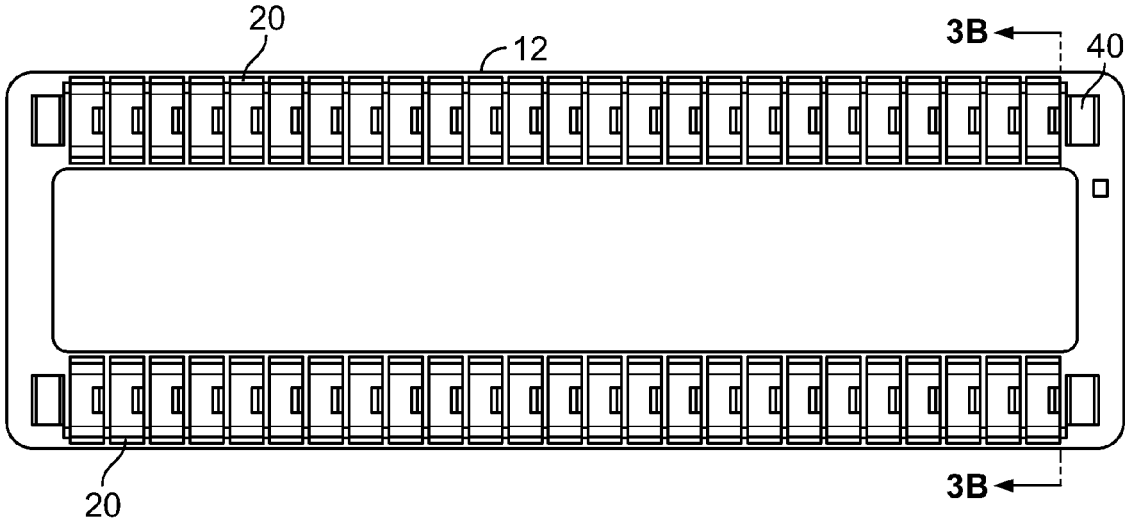
FIG. 3 depicts the housing from at top view, in cross-section and a blow-up of an aperture.
Figure 3B:
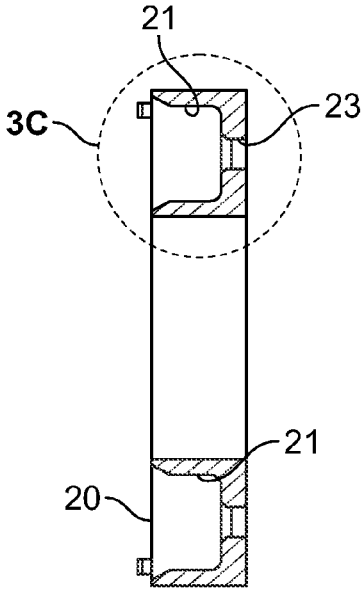
Figure 3C:
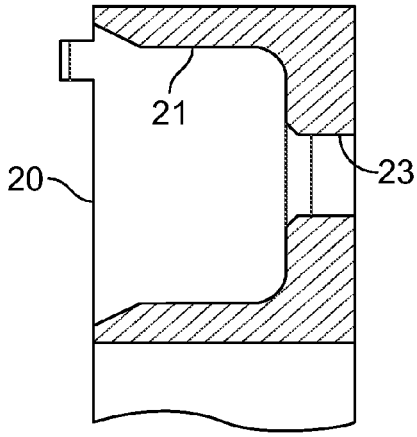

The housing is depicted in FIG. 3. FIG. 3A depicts a top view of the housing 12, while FIG. 3B depicts a cross section of the housing 12, while FIG. 3C depicts a detailed view of a housing aperture 20. The housing 12 includes a plurality of apertures 20. A contact 22 is assembled into apertures 20 on opposed sides 13,15 of housing 12, the spacing of the assembled contacts 22 corresponding to the spacing of the strips in the foil array 10.

Referring again to FIG. 2, each contact 22 includes an upper U-shaped portion 24 having a pair of arms 26 connected to a lower leg 28. The upper U-shaped portion 24 of each contact is sized to reside in the upper portion 21 of aperture 20. The upper portion 21 of aperture 20 is preferably slightly wider than the upper U-shaped portion 24 of contact. Similarly, the lower portion 23 of aperture 20 is slightly wider than the lower leg 28 of contact 22. This allows contacts 22 to float within the housing 12 thereby allowing forces on the strip to reach equilibrium. The lower leg 28 of each contact 22 extends through housing 24, allowing the assembly to be connected to form a complete circuit by establishing a connection between the strips 14 at one end and the legs 28 at the other. The lower leg extending through the housing is clearly depicted in FIG. 4. The foil array 10 assembled to a housing 12 having contacts 22 utilizing a beam 30 constitutes an assembly 38. While FIG. 2 illustrates a preferred geometry for contact 22, other contact configurations that establish a reliable connection between the contact 22 and the foil to establish a circuit through assembly 38 are also contemplated by the invention.

Figure 4:
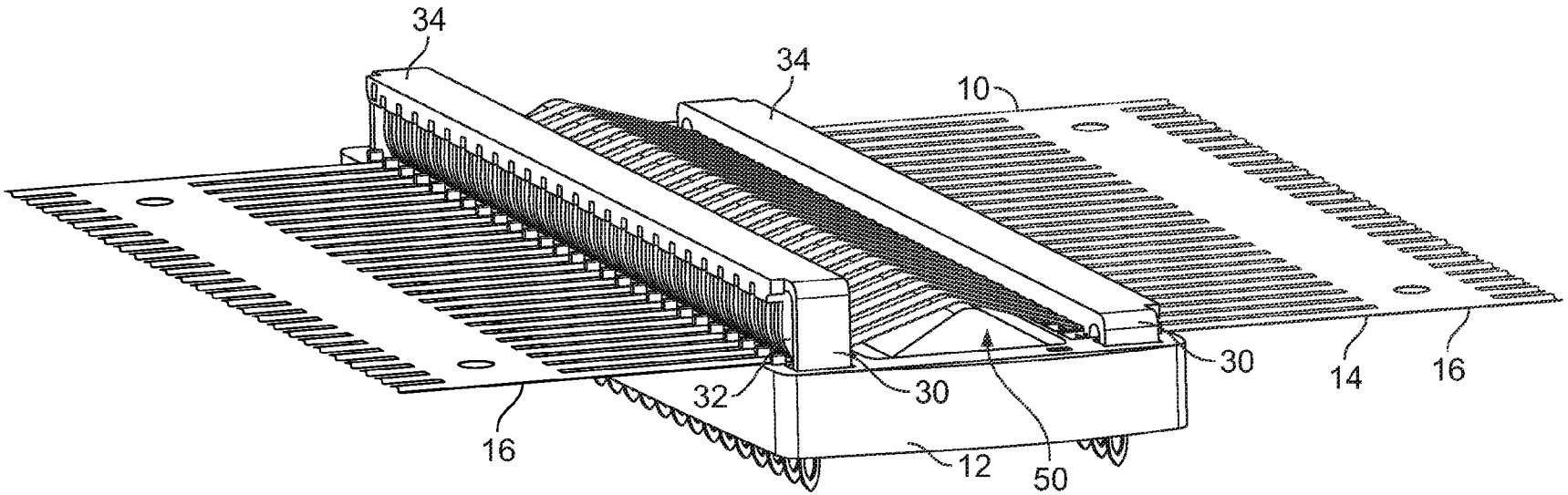
FIG. 4 is a perspective view of the foil assembly of the present invention being assembled to the housing.

Foil array 10 is assembled to housing 12 as depicted in FIG. 4. Foil array 10 comprises a plurality of strips 14 that span the housing 12 laterally. The strips are connected longitudinally, perpendicular to the direction that the plurality of strips 14 span the housing, by attachment to a longitudinal band 16 at each end of each strip 14. Each of the strips in the plurality of strips spans the same distance about the housing 12. The longitudinal bands 16 may be attached to a ribbon (not shown) wider than a strip positioned at each end of the foil array 10 parallel to the plurality of strips. The longitudinal bands 16 and ribbons are provided to assist in handling the foil array and may be removed after assembly is completed. The foil array 10, which can be fabricated as a roll that includes a plurality of separable foil arrays, is assembled to the housing 12. The foil array 10 is assembled across the housing 12 and guided by guide ribs 17 in the housing so that the array of strips correspond to contacts 22 in the apertures 20 on opposite sides 13, 15 of housing 12. Next, a pair of beams 30 is provided. The beams 30 include a plurality of fingers 32 extending away from beam top surface 34, each finger sized to be assembled into an aperture 20 that includes a contact 22. Although beams 30 are shown individually as a separate pair, it will be understood that beams 30 can be provided as a single piece having a plurality of fingers 32 corresponding to apertures 20 extending away from a top surface.

A mandrel 50 is provided to support the foil array 10 during assembly. The mandrel 50 is a small surface area mandrel that contacts the plurality of strips on the underside, that is, on the side opposite of the beam top surface 34 as shown in FIG. 4. As the beams 30 are inserted into the apertures, each of the fingers 32 applies a normal force to the portion of each strip 14 of the plurality of strips that it contacts, urging it downward and into the upper U-shaped portion 24 of contact 22, slightly deflecting the arms 26 of contact 22 outwardly within the aperture toward the walls of the housing. This is possible as the upper portion 21 of aperture 20 is slightly larger than the U-shaped portion 24 of the contact 22. The thin foil is self-centered in the U-shaped portion 24 of contact 22, and thus captured in the aperture by the upper U-shaped portion 24 between the arms 26 and the finger 32, the finger exerting a force on the both the arms 26, placing the arms in tension and a normal force on the foil strip 24 adequate to break any oxides on the metal foil. A two-point contact between the foil strip 14 and the contact 22 is established by this arrangement. If desired, the beams 30 may include a latch feature such as depicted in FIG. 2, on at least one end of each beam 30, and preferably a latch 36 at each end of the beam 30, for retaining the beam and contacts in housing 12. This can be a male latch device in the beam and a female latch receiving mechanism in the housing. In this circumstance, the housing includes at least one corresponding structure, here a latch-receiving aperture 40 as a mating feature to correspond to the latch feature 36 of the beam 30. The latch feature 36 is depicted in FIG. 2 as a shouldered protrusion, and the mating feature in the housing is a slot 40 that captures the shoulder on the protrusion. However, these configurations may be reversed. These are preferred embodiments, and any other suitable locking mechanism may be used.

The mandrel 50 provides support for the foil array 10 as the beams 30 are pushed downward. After the assembly of foil array 10 into the contacts on a first side of housing 12 using a beam 30, thereby trapping the foil array 10 on the first side of the housing, the foil is draped over small area mandrel 50 and maintained in contact with the mandrel 50 as the free end of the foil array is identically assembled into the opposite side of the housing 12, after which mandrel 50 can be removed. At this point the plurality of strips 10 are in compression, which is evident since a slight radius exists in the strips across the span between the apertures 20 in the housing 12. A mandrel 50 is inserted as described between the opposed sides 13, 15 of housing against the foil array until the strips spanning the mandrel are taut. In a preferred embodiment, the mandrel should be sized to contact about 50% or less of each strip of the plurality of strips between apertures on either side of the housing as the assembly proceeds. Preferably, the mandrel should be sized to contact about 25% or less of each strip of the plurality of strips between apertures on either side of the housing as the assembly proceeds. Most preferably, the mandrel should be sized to contact about 10% or less of each strip of the plurality of strips between apertures on either side of the housing as the assembly proceeds. Then the beams are assembled, capturing the foil strips 14 in the contacts as described above. Upon removal of the mandrel 50, any applied tensile stresses in the strips between opposed sides 13, 15 are removed. In an alternate embodiment, the strips may be sufficiently long to allow them to be looped around convoluted or arcuate areas in which substantially straight strips cannot be utilized. In this circumstance, no mandrel 50 is required to assemble the foil array to the housing. Also increasing the length of the arc will vary the resistance of the strip, thereby permitting further control of heat capacity of the strip. Thus, by carefully controlling the length of the strips and the geometry of the foil, the arc length of the assembled foil can be varied as desired.

Figure 5:
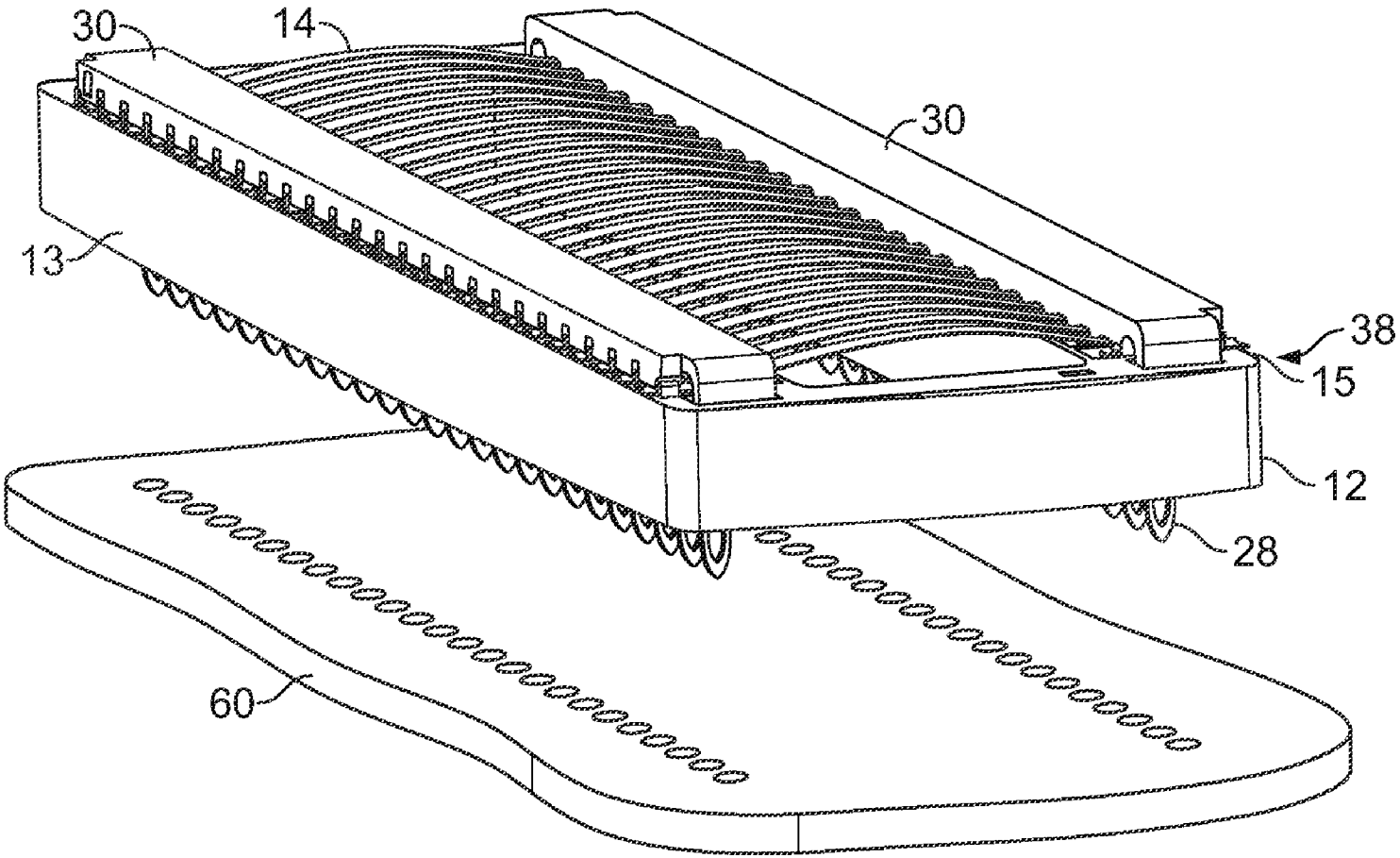
FIG. 5 is a schematic depicting the assembly being assembled to a printed circuit board.

The foil array 10 when joined to the housing 12, as described above, is firmly seated in the upper U-shaped portion 24 of contacts 22, the lower leg 28 of contacts protruding through the bottom of housing 12 constitutes an assembly. With the plurality of strips 14 captured in apertures 20 on either side 13, 15 of the housing, the foil material 62 extending outwardly beyond the housing is removed by any convenient method. Preferably, a trimming tool can be used to remove the excess foil in a single operation. A circuit exists running from the lower leg 28 of contact 22 extending below housing 12. The plurality of strips form an arch 64, the strips relaxing to a compressive state on removal of the mandrel. The strips thus do not form a plane across the sides of housing 13, 15, but rather form an arch that extends slightly above a plane that would include the top surface of the housing 12. Preferably, the apex of the arch formed by each strip is a point, such that these points formed by the apex of each strip form substantially a straight line. As used herein, the term "form substantially a straight line" is governed by good manufacturing practice. The circuit runs through the contact, across strip 66 to the contact on opposed side of housing 13 to the lower leg 28. A plurality of separate circuits are thus provided. Clearly, if no strip is provided in the foil array at a position across opposed contacts on the housing, no circuit is available at this position. Alternatively, if contacts are omitted in apertures on one or both sides of the housing, again no circuit is available. Thus it is possible to tailor the final assembly to a predetermined configuration, if desired. This can be particularly useful if a circuit is not desired or required across each and every pair of apertures. This assembly 38 can then be connected to a power source, such as being plugged into a PCB 60 as depicted in FIG. 5, in a preferred embodiment. A controller can be provided as required, and may readily be included as part of the PCB or as a separate component. The controller can be configured and programmed to allow a flow of current across a single strip in the foil array 10, or over a plurality of strips 14 in the array 10, as desired In operation, each strip 14 in the foil array 10 is designed to allow passage of a preselected amount of current. The PCB can be designed so that the preselected current passes through each strip only once, if so desired. There are a number of uses for such a device. For example, each strip can be designed so that a strip fails if the current exceeds a predetermined level. Alternately, the PCB can be designed so that when a predetermined current level is reached, additional strips automatically can be switched in to the circuit to provide additional current to meet a demand. A material of high conductivity should be provided for this application, such as copper. The strip can also be designed so that the current passing through it results in the strip reaching a preselected temperature, at which temperature a physical event occurs, such as the melting of an applied material The strips can be designed to provide heat, in which the material selected should have a high resistivity, allowing each strip to be a resistance heater. One such material is stainless steel, such as a high chromium stainless such as a 300 series stainless steel, and preferably a 304 stainless steel. Not only do such steels form good resistors, but also resist oxidation/corrosion at elevated temperatures. This can allow precision heating of a small space by carefully controlling the heat input into the space. Clearly, the use of the foil will dictate its design, and the design is within the skill of the artisan once the use is known. Thus, a preselected temperature or current carrying capability can be achieved by proper selection of material, strip width and strip thickness. The material selected for the foil can have a high resistivity or high conductivity, depending on the application. For most applications, the foil thickness is about 0.0005 inches (about 12 microns) although thicknesses as thick as 0.005 inches and as low as about 0.0001 inch can be utilized. The only limitation on the minimum thickness is the ability to manufacture foil of sufficient thickness. The most cost effective method for manufacturing foil is by rolling it to the desired thickness and then slitting it into the desired array pattern. The configuration of the foil can also be achieved by chemical etching or laser cutting. Stamping of the configuration may also be possible. However, it may be possible to achieve micron or even submicron foil thicknesses by electrochemical etching or vapor deposition methods, although such methods will substantially increase the cost and require special handling precautions to prevent damage to the foil.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A thin foil metal contact assembly, comprising:

a housing having a pair of opposed sides, each side including a plurality of apertures having an upper portion and a lower portion, the apertures on each side of the pair corresponding to apertures on the opposed side;

a plurality of metal contacts positioned in apertures on opposed sides of the housing, each contact having an upper U-shaped portion positioned in a corresponding upper portion of an aperture and a lower leg positioned in the lower portion of one of the apertures;

a metallic foil having a plurality of strips of a predetermined width and predetermined thickness of 0.005 inches and less extending across a pair of opposed bands, each of the strips of the metallic foil corresponding to the contacts in corresponding apertures; and a beam having a plurality of fingers mating with the plurality of contacts in the apertures, the fingers of the beam urging each strip of the plurality of strips of the metallic foil against the U-shaped portion of contacts, the lower leg of each contact extending from the housing opposite the U-shaped portion of the metal contact.

2. The thin foil metal contact assembly of claim 1 further comprising, a pair of beams, each beam having a plurality of fingers mating with the plurality of contacts in the apertures, one beam mating with the apertures on one of the pair of opposed sides of the housing, the fingers of the beam urging each strip of the plurality of strips of the metallic foil against the U-shaped portion of contacts, the lower leg of each contact extending from the housing opposite the U-shaped portion of the housing, each beam.

3. The thin foil metal contact assembly of claim 1 wherein the metallic foil is ultra-thin, having a thickness of 0.0005" and less.

4. The thin foil metal contact assembly of claim 1 wherein the beam urging each strip of the metallic foil against the U-shaped portion of the contacts captures the metal foil against the contact, thereby forming a mechanical connection between the contacts and the strip suitable for conduction of an electrical current therethrough.

5. The thin foil metal contact assembly of claim 4 further including a locking mechanism between the beam and the housing to maintain the strips of the metallic foil in mechanical connection with the U-shaped portion of the contacts.

6. The thin foil metal contact assembly of claim 5 wherein the locking mechanism between the beam and the housing includes at least one latch in one of the housing and the beam, and at least one latch receiving mechanism, corresponding to the at least one latch, in the other of the housing and the beam.

7. The thin foil metal contact assembly of claim 5 wherein the locking mechanism between the beam and the housing includes a male latch in the beam and a corresponding aperture in the housing.

8. The thin foil metal contact assembly of claim 5 wherein the metallic foil having a predetermined thickness is selected to accomplish a predetermined result, the foil material, width and length being selected consistent with the predetermined result.

* * * * *